United States Patent [19]

Richard

[11] 3,938,533

[45] Feb. 17, 1976

[54] AUTOMATIC SCULLERY SYSTEM

[76] Inventor: Wilton Richard, Rte. 1, Box 359-1/2, Shreveport, La. 71105

[22] Filed: Oct. 29, 1973

[21] Appl. No.: 410,482

[52] U.S. Cl. ..... 134/63; 134/62; 134/68; 134/115 G; 209/111.8

[51] Int. Cl.[2] ..... B08B 3/02; B08B 3/10

[58] Field of Search ..... 134/62, 63, 68, 115 G; 209/111.8; 335/302

[56] References Cited

UNITED STATES PATENTS

| | | | |
|---|---|---|---|
| 3,232,425 | 2/1966 | Le Van Hansen et al. | 134/63 X |
| 3,247,858 | 4/1966 | Kraeft | 134/63 X |
| 3,389,711 | 6/1968 | Slayton | 134/63 |
| 3,483,877 | 12/1969 | Naslund | 134/63 X |
| 3,486,939 | 12/1969 | Pinckard | 134/63 X |
| 3,520,726 | 7/1970 | Gay | 134/63 |

*Primary Examiner*—Robert L. Bleutge
*Attorney, Agent, or Firm*—John F. Sieberth

[57] ABSTRACT

Apparatus for automatically processing carrying trays having used culinary items and refuse thereon whereby desired operations, such as collection and cleaning of reusable culinary items (e.g. knives, forks and spoons), separation and disposal of waste, and cleaning of the trays can be effected without need for operating personnel. In preferred systems the apparatus automatically stacks the cleaned trays and sorts and collects the cleaned reusable culinary items by type so that the trays and the culinary items are readily available for reuse.

15 Claims, 22 Drawing Figures

AUTOMATIC SCULLERY SYSTEM

BACKGROUND OF THE INVENTION

Various methods and apparatus for cleaning and sorting culinary items have been proposed heretofore. See for example U.S. Pat. Nos. 3,247,858; 3,483,877; and 3,486,939. As pointed out in U.S. Pat. No. 3,486,939 most of these prior proposals have had limitations in operational capacity because of the inherent handling time involved in mechanically sensing and sizing the configuration of the object to be sorted or classified. Also, despite the use of various types of automated equipment these prior systems have required the presence of attendants to carry out manual sorting operations or the like.

The apparatus described in U.S. Pat. No. 3,486,939 which is designed to overcome prior limitations on operational capacity and reduce the number of attendants required in the operation, involves separating magnetically responsive chinaware from magnetically responsive silverware by passing the silverware through a grid which retains the chinaware, and then passing the separated items through a number of stations whereby the various articles are classified and isolated from each other. The silverware, for example, is passed through several magnetic stations of different field strengths, the effectiveness of the separations being dependent upon one type of silverware (e.g., spoons) being selectively removed from other magnetically responsive silverware by virtue of the strength of the particular magnetic field through which they pass. Thus for the silverware alone the use of three different magnetic stations of different field strengths is described. In addition, the system involves several operations in which operating personnel participate.

SUMMARY OF THE INVENTION

This invention provides, inter alia, automated scullery apparatus which, by virtue of its compactness and operating efficiency, is well suited for use in restaurants, cafeterias, hospitals, hotels, convention centers, correctional institutions, schools and in general, in all types of establishments or institutions, whether public or private, where food or refreshments are served. In the over-all systems of this invention trays carrying used culinary items or utensils, paper napkins, food waste and other refuse are passed into the apparatus, preferably at one end thereof, and thenceforth the apparatus performs a series of operations whereby at least the trays are cleaned—e.g., washed and dried—and collected, preferably at or near the opposite end of the apparatus, for dispensing to the patrons of the establishment. The waste material, which may include the used culinary items if they are disposable rather than reusable, is automatically collected and disposed of by the apparatus.

In the preferred systems of this invention at least some of the culinary items or utensils are reusable and in these embodiments the selected, reusable culinary items (preferably the silverware) are removed from the carrying trays by the apparatus and then refuse remaining on the trays is automatically removed therefrom and collected and dispensed with. The trays and preferably the selected reusable culinary items are subjected in the system to separate cleansing operations and thereafter are collected by the apparatus for dispensing to the patrons. In the course of these operations means are provided for classifying the culinary items according to like articles—spoons, knives, and forks, for example—and the classified articles are isolated each from the other. In this way the sorted articles are automatically collected for reuse after they have been washed and dried or otherwise suitably cleansed by the apparatus.

Although other suitable methods may be devised for selectively removing the reusable culinary items from the carrying trays and the other articles or debris thereon, it is preferable to employ magnetically responsive culinary items as the reusable items and to employ automated apparatus which magnetically removes such items from the trays. Particularly preferred magnetically-responsive culinary items and apparatus for use therewith are described hereinafter and in application Ser. No. 410,481, filed concurrently herewith, now U.S. Pat. No. 3,877,577.

Disposable culinary items for use in the apparatus of this invention are preferably fabricated from frangible material such as breakable plastics or the like. This facilitates their disposal as the apparatus can crush or grind them into comminuted form which can readily be disposed of by incineration or flushing operations.

Thus this invention in one particularly preferred form provides, inter alia, automated apparatus which takes in trays carrying dirty disposable dishes made from frangible material and reusable silverware. The apparatus automatically recovers, cleanses, separates and segregates the silverware according to type so that it is available for reuse by incoming patrons; dumps the dishes, food and other debris out of the trays; cleanses the trays; crushes or comminutes and disposes of the dirty dishes and other debris or waste; and collects and stacks the cleansed trays for reuse by incoming patrons. By virtue of the nature and sequence of the operations used it is possible, if desired, to enclose all such equipment in a relatively compact cabinet unit which can be utilized as the base of a serving table from which the patrons obtain fresh trays, silverware, food and beverages, napkins, etc., and to which the debris-laden trays are returned for automatic processing by the equipment. If desired the silverware may constitute a disposable culinary item and dishes or the like may constitute the culinary items selected for reuse. It is also possible to design systems in accordance with this invention in which both silverware and dishes constitute reusable items which are recovered, cleaned and segregated according to the type by the apparatus.

The above and other embodiments, aspects, features, advantages, objects and characteristics of this invention will become still further apparent from the ensuing description, appended claims and accompanying drawings wherein like characters of reference designate like parts.

Figure 6:
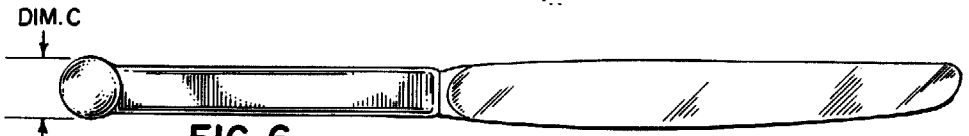
FIGS. 4 and 4A, 5 and 5A, and 6 and 6A depict preferred magnetically responsive silverware suitable for use with the apparatus of FIGS. 2A and 2B, FIGS.
Figure 6A:
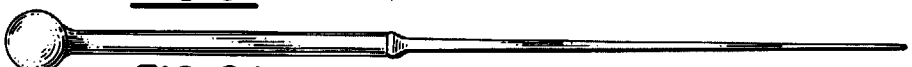
Figure 4:
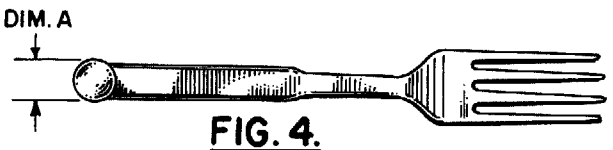
Figure 4A:
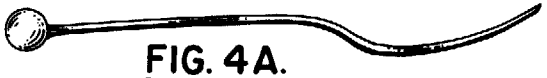
Figure 5:
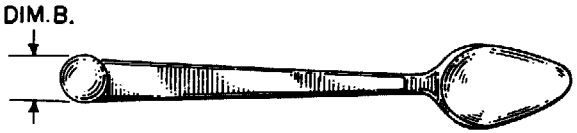
Figure 5A:
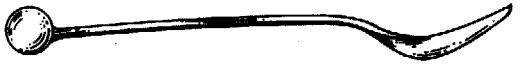

4, 5 and 6 representing top views and FIGS. 4A, 5A and 6A representing side views of the silverware.

Figure 3A:
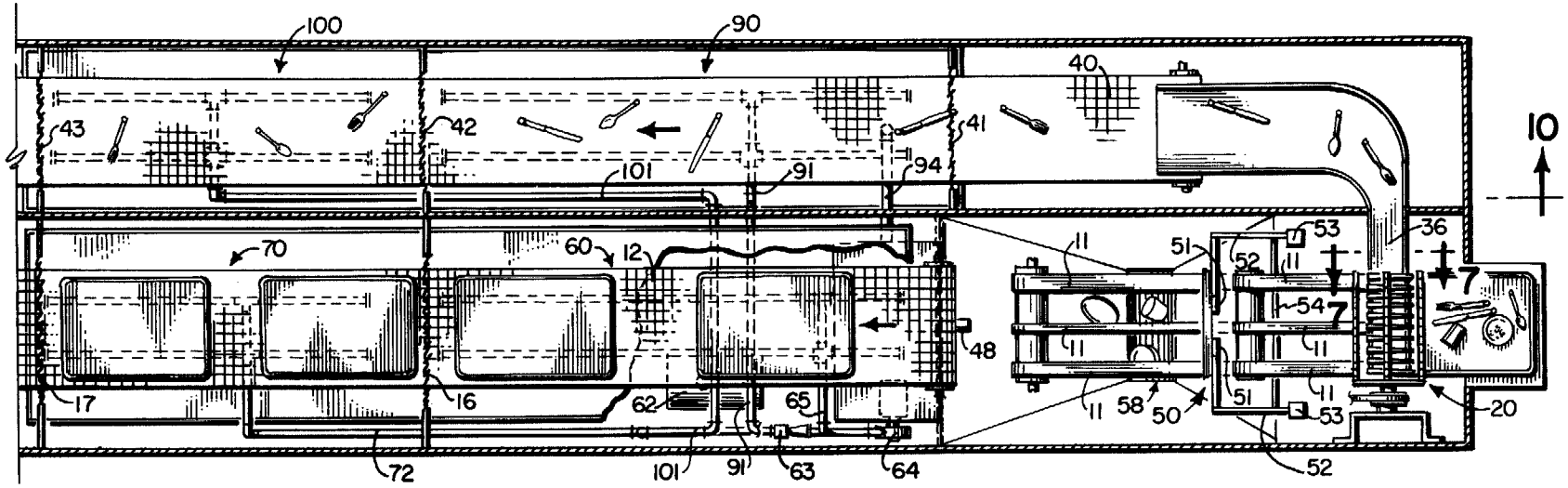
FIGS. 3A and 3B taken together constitute a top plan view of the apparatus of FIGs. 2A and 2B.
Figure 7:
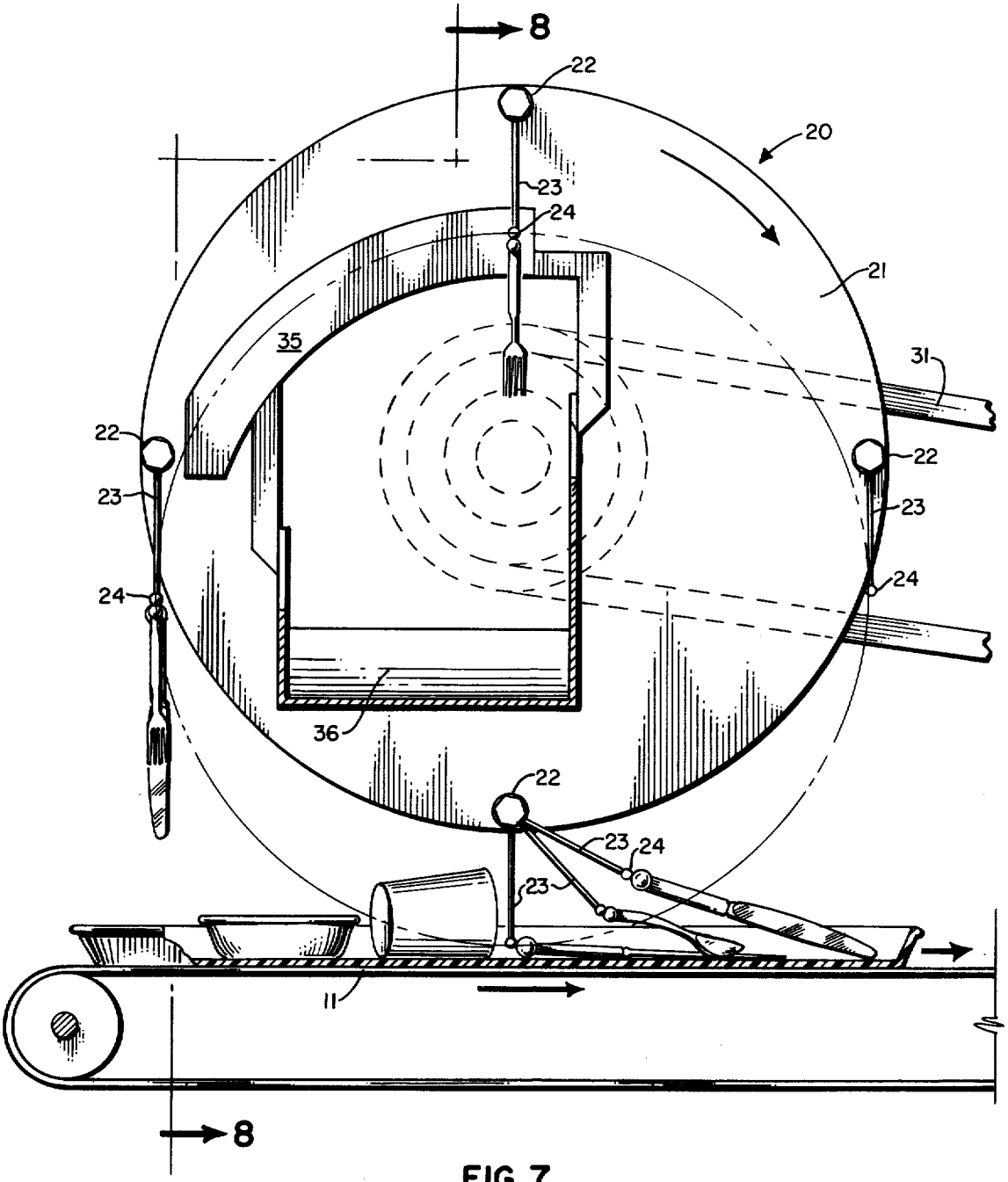

FIG. 7 is an enlarged side view taken along line 7—7 of FIG. 3A of a preferred apparatus for automatically removing silverware from carrying trays and causing its transfer to a system for cleaning the silverware.

Figure 8:
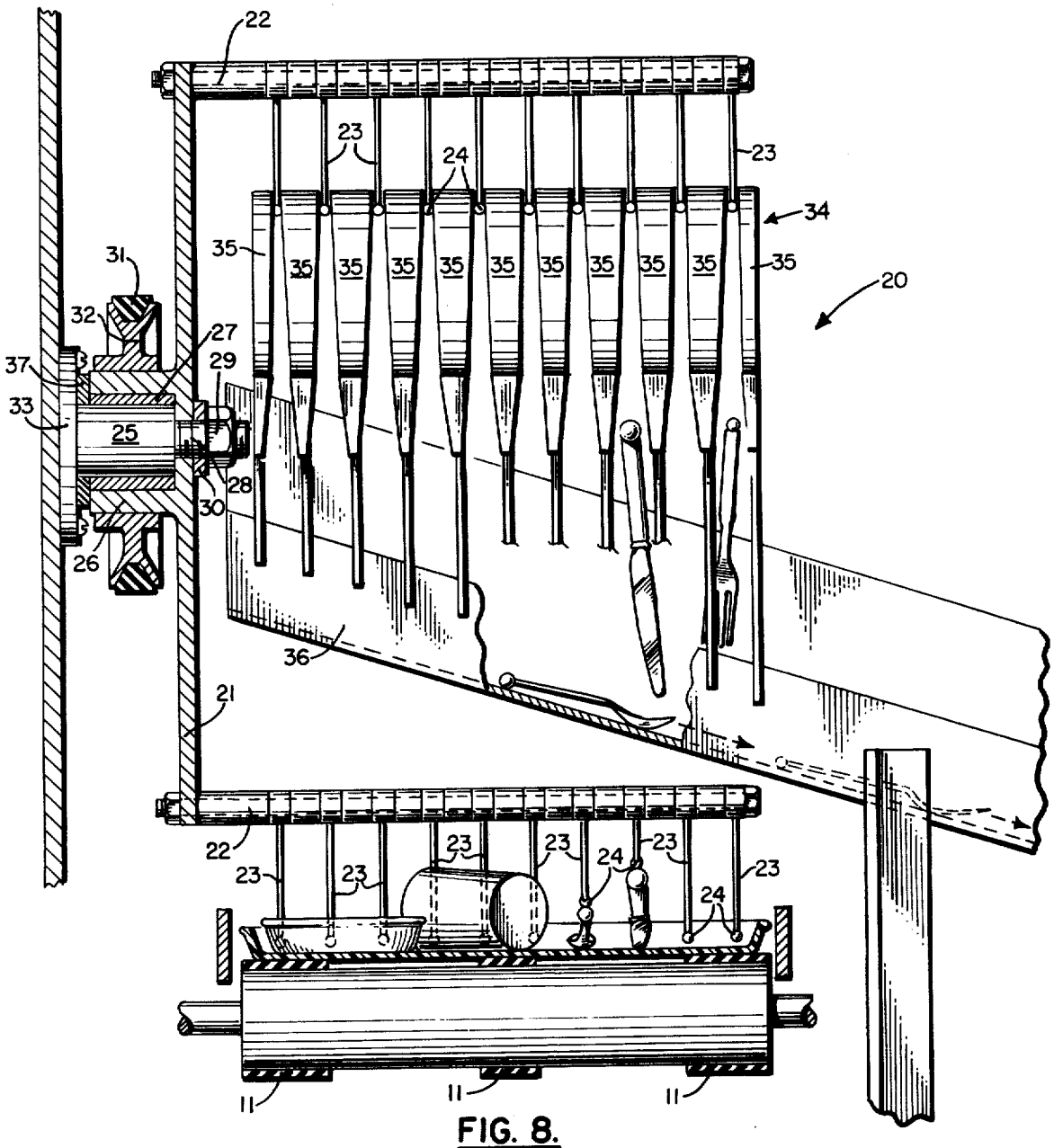

FIG. 8 is an enlarged frontal view of the apparatus of FIG. 7 taken along line 8—8 thereof.

Figure 11:
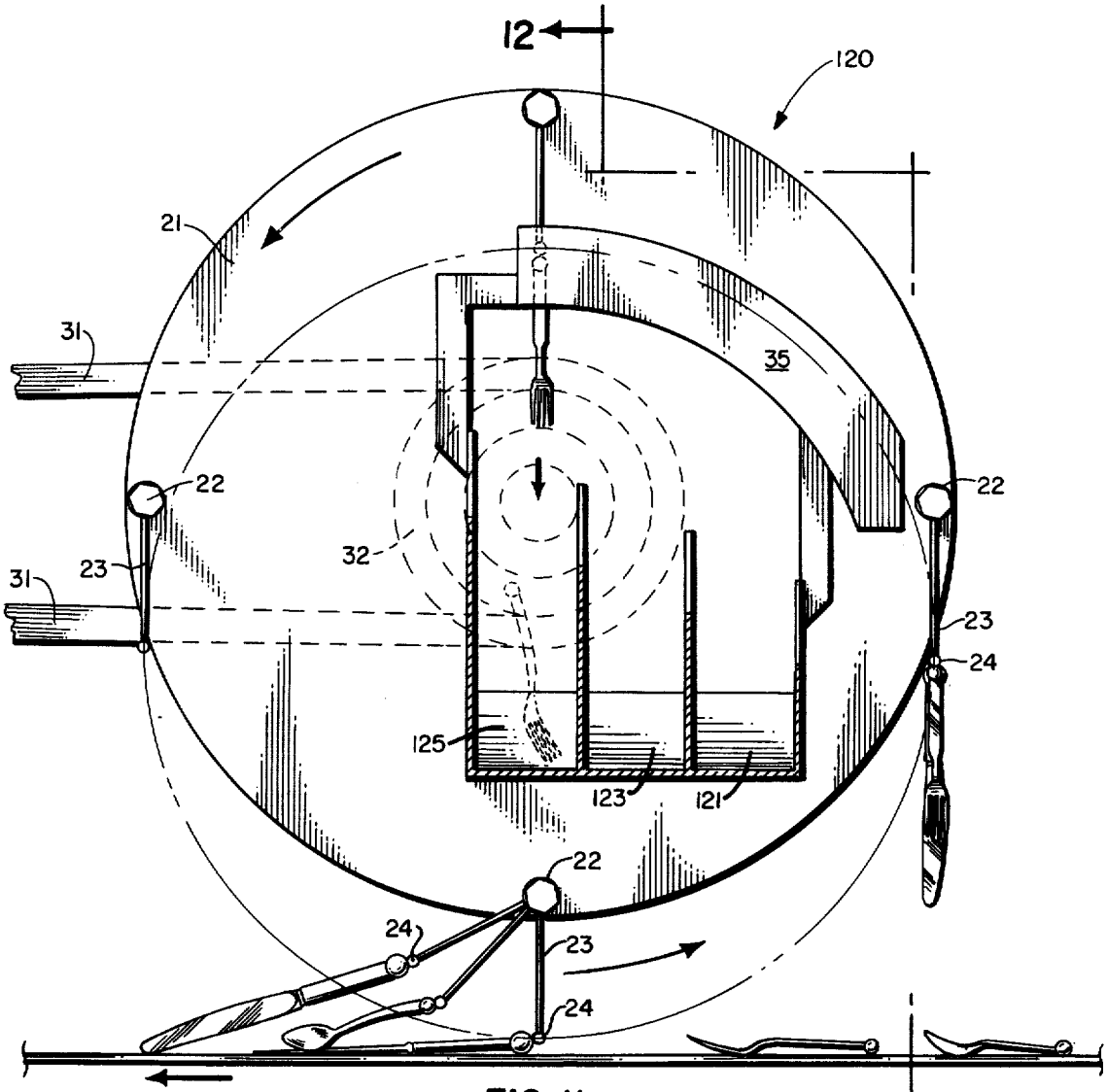
Figure 9:
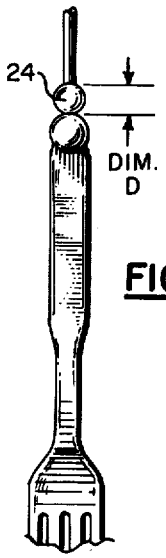
Figure 12:
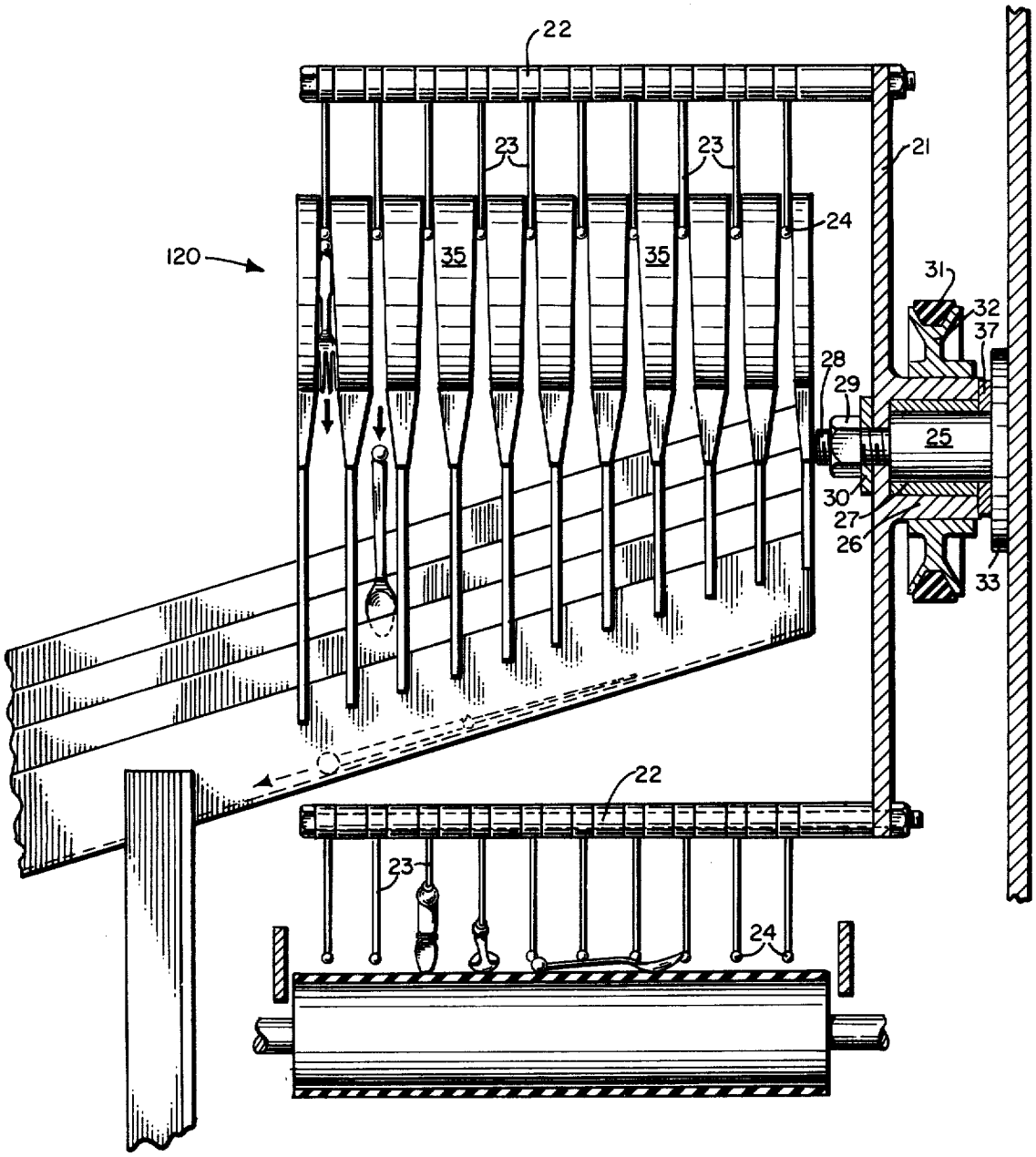

FIG. 9 is an enlarged view of magnetic engagement between a magnetically responsive article of silverware (viz., a fork of FIGS. 4 and 4A) and a suspended magnetic lifter or finger of the apparatus of FIGs. 7 and 8 and also of the apparatus of FIGS. 11 and 12.

Figure 10A:
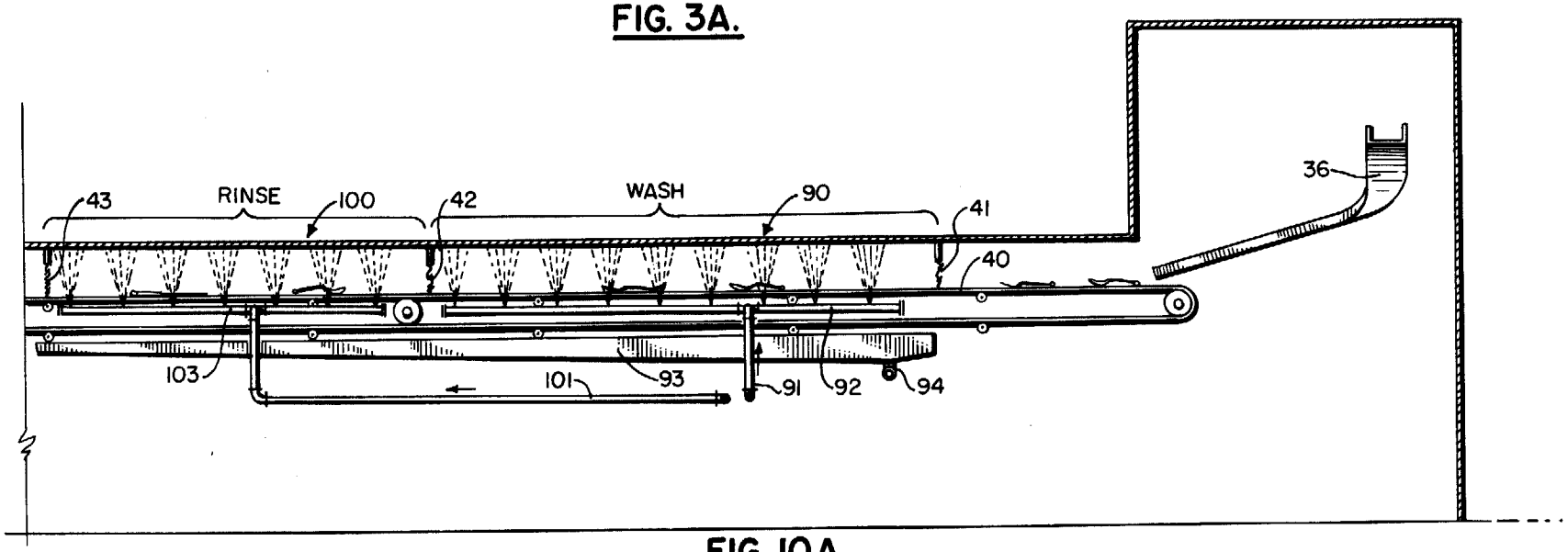
Figure 3B:
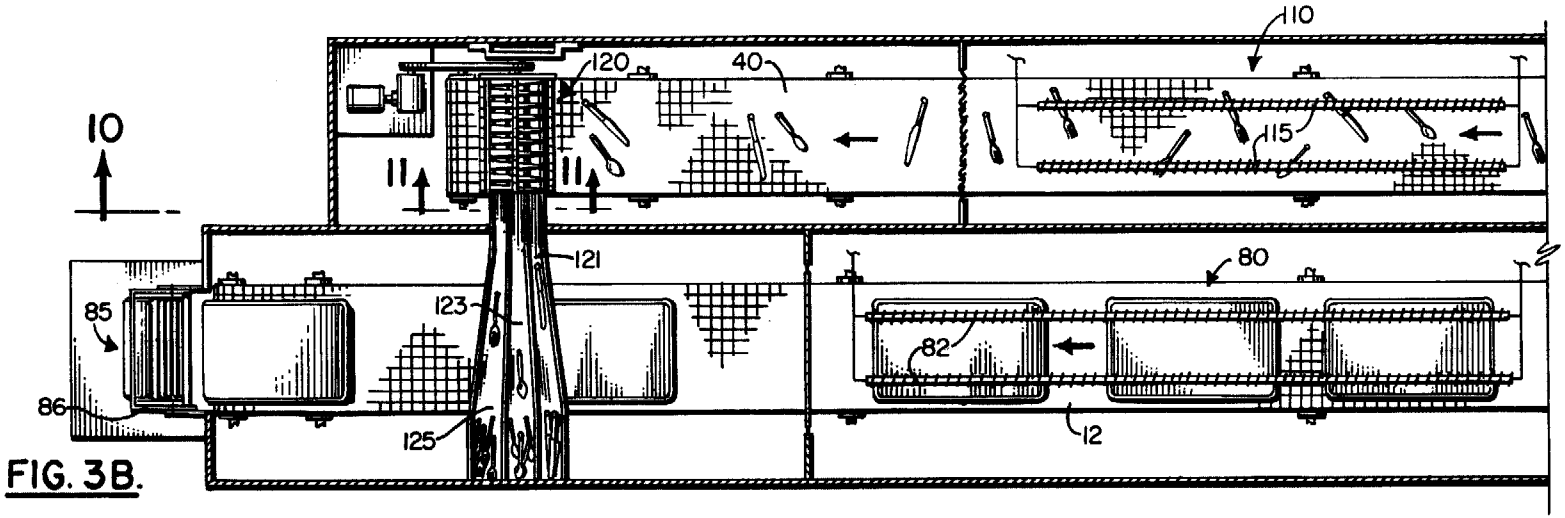
Figure 10B:
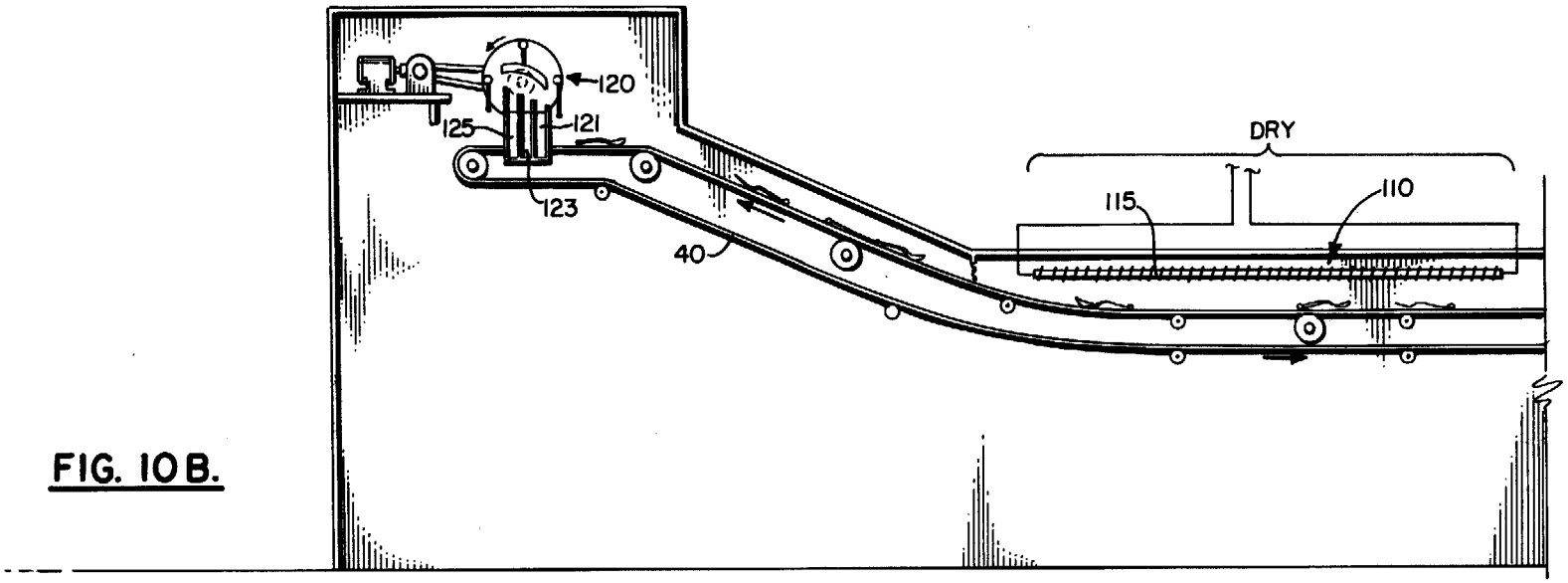

FIGS. 10A and 10B taken together constitute a side elevation taken along line 10—10 of FIGS. 3A and 3B depicting a system for automatically washing, rinsing, drying, collecting and sorting silverware transferred to the system by the apparatus of FIGS. 7 and 8.

FIG. 11 is an enlarged side view taken along line 11—11 of FIG. 3B of a preferred apparatus for automatically gathering the cleaned and dried silverware, classifying the silverware according to like articles, isolating the classified articles each from the other and causing transfer of the isolated articles to collection bins where they are available to patrons of the establishment.

FIG. 12 is an enlarged frontal view of the apparatus of FIG. 11 taken along line 12—12 thereof.

Figure 1:
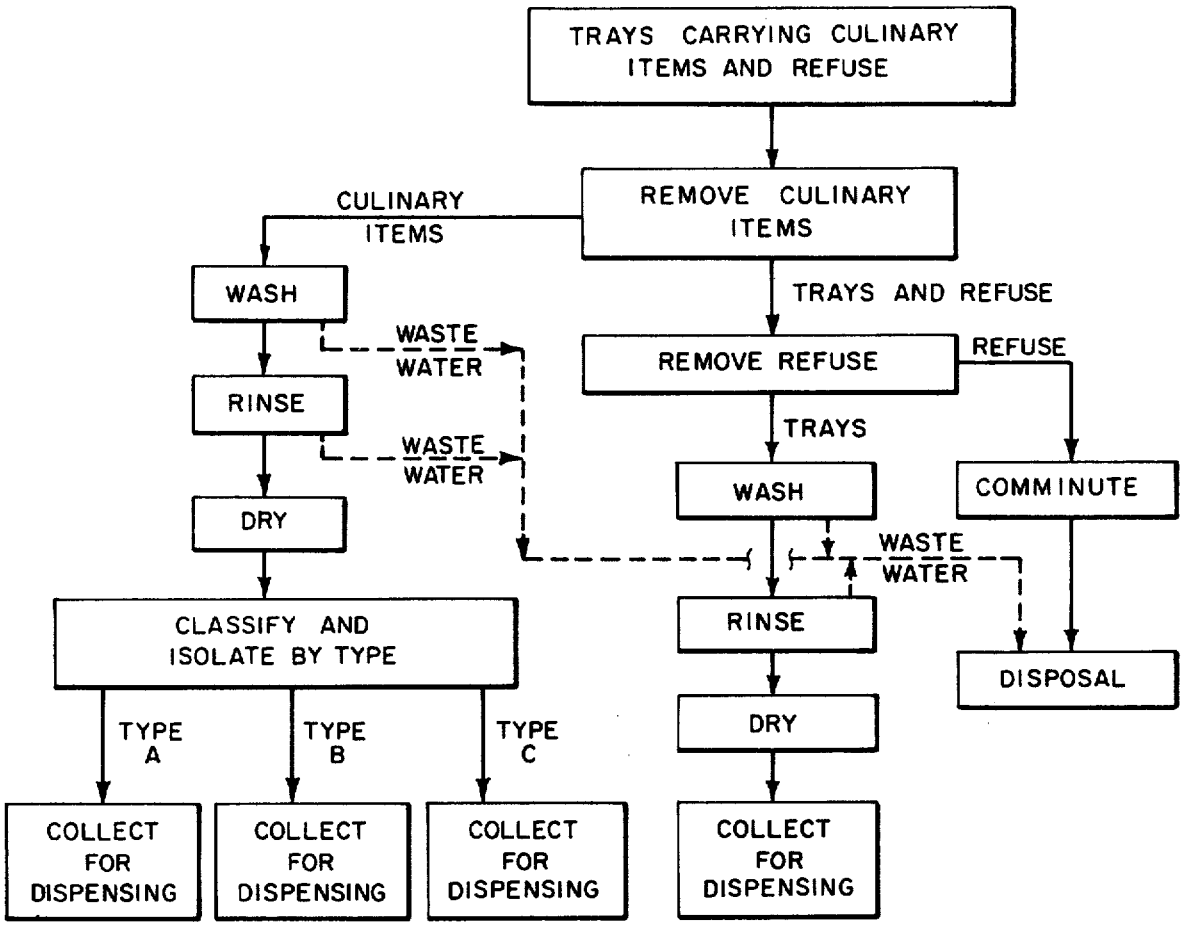
FIG. 1 is a block diagram illustrating the sequence of operations performed in a preferred over-all scullery system of this invention.
Figure 13:
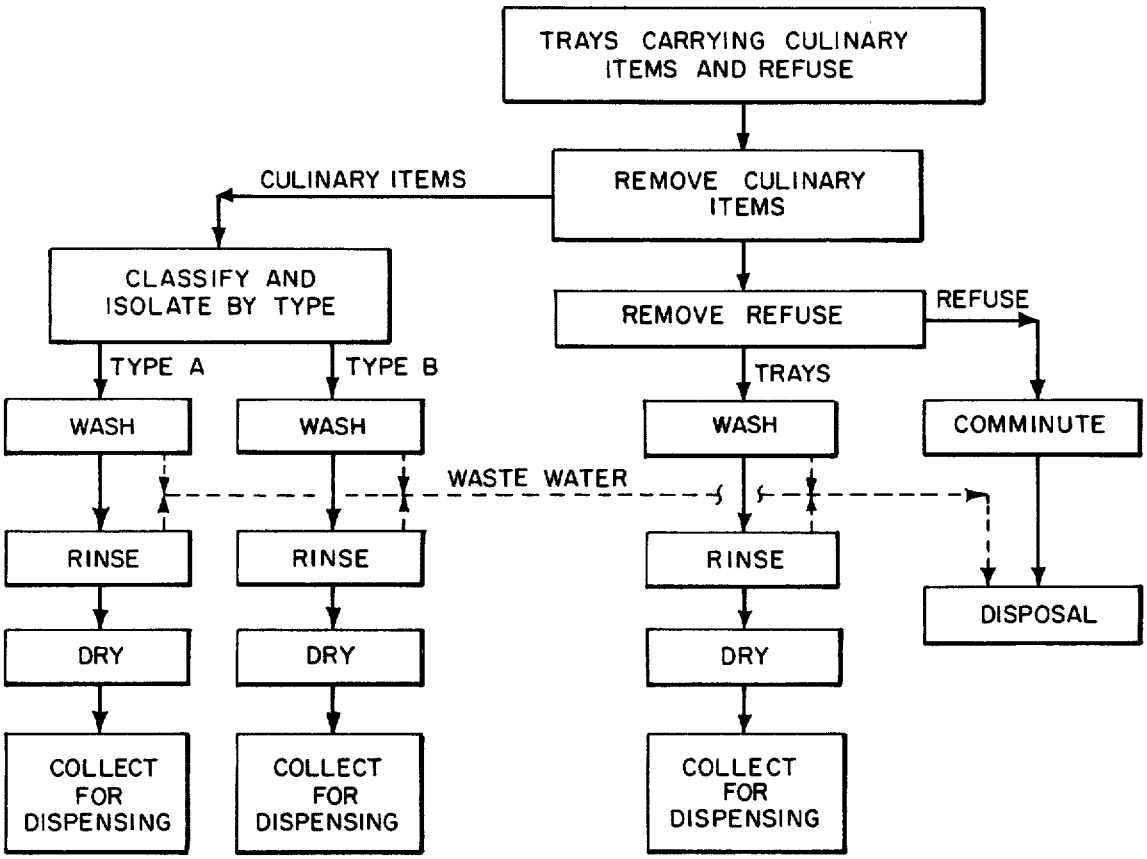

FIG. 13 is a block diagram illustrating the sequence of operations performed in a preferred over-all scullery system of this system differing from that illustrated in FIG. 1.

Figure 14:
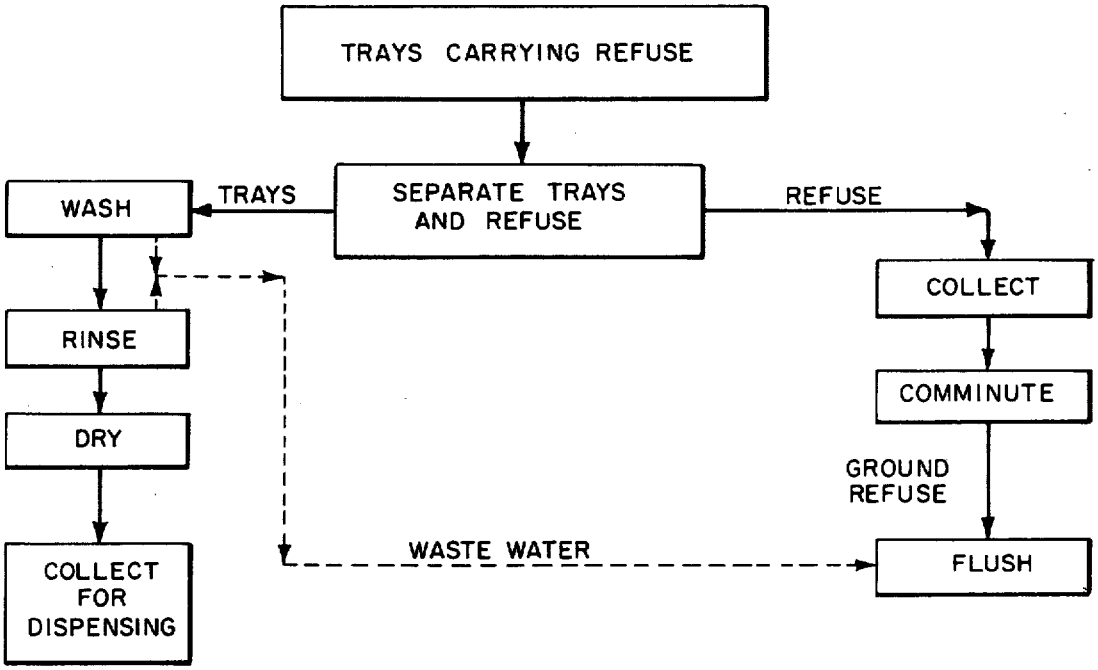

FIG. 14 is a block diagram illustrating another sequence of operations of this invention.

Figure 15A:
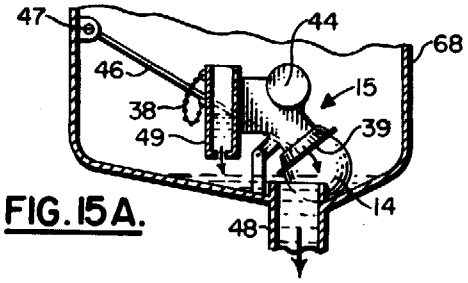
Figure 15:
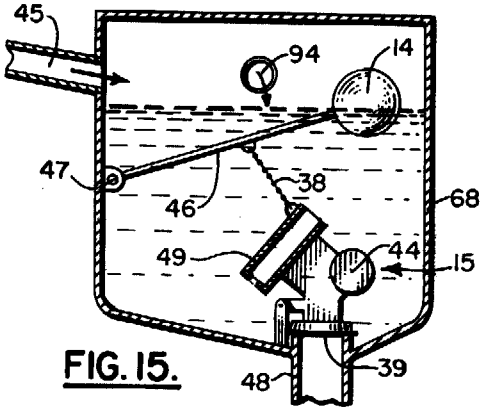

FIG. 15 is an enlarged detail view of a refuse flushing system preferably employed pursuant to this invention, the valve of the system being shown in closed position. FIG. 15A is a partial view of the system of FIG. 15 showing the valve in open position.

In the foregoing brief description the "side" views in FIGS. 2A, 2B, 7, 10A, 10B and 11 are designated as such in the sense that they represent views perpendicular to the principal direction of travel of the objects conveyed through the apparatus depicted, and the "frontal" views of FIGs. 8 and 12 are so designated in the sense that they represent views looking in the same direction as the principal direction of travel of the conveyed objects. It will be appreciated, of course, that the apparatus may be situated in any suitable direction in the premises in which it is employed and accordingly, the terms "side" and "frontal" are not used and are not to be construed in a restrictive or limitive sense. Rather, they are to be considered merely as terms of convenience for description purposes.

DETAILED DESCRIPTION

A feature of this invention brought out by the sequence of operations referred to in FIGS. 1 and 13 is that reusable tray-carried culinary items (e.g., silverware utensils) are selectively removed from the trays at an early stage in the operation of the system. This facilitates subsequent processing in that refuse and other disposable materials remaining on the trays can be readily removed therefrom, and the trays can then be cleaned and collected by the apparatus for reuse. Further, selective removal of the reusable culinary items from the trays at an early stage in the operation enables these items to be promptly transferred to that portion of the apparatus which cleans, sorts and collects, or sorts, cleans and collects these items for reuse. In other words, rather than using a sequence of stepwise separations involving a series of manipulations or transfers from one conveyor to another as taught in U.S. Pat. No. 3,486,939, the present system involves promptly making a selective separation of reusable culinary items followed by a gross separation between tray and residual contents thereof. Following these operations the several materials (trays, reusable items, and refuse) are concurrently handled with dispatch by durable, relatively simple apparatus so that high operating efficiency can be achieved without large capital investment or excessive operating costs.

By referring to FIGs. 2A, 2B, 3A, 3B 10A and 10B it will be seen that in general the automatic scullery apparatus of this invention comprises means for removing from carrying trays selected culinary items carried thereon; means for cleansing the culinary items removed from the trays; means for collecting the cleansed culinary items; means for releasing refuse remaining on the carrying trays after said selected items have been removed therefrom; means for cleansing the trays; and means for collecting the cleansed trays. In this apparatus it is desirable to further include means for comminuting refuse released from the carrying trays. As noted above the apparatus preferably includes means for classifying the removed culinary items according to like articles and isolating the classified articles each from the other. From a comparison of FIGS. 1 and 13 it will be seen that there are two particularly useful stages at which this classification can be effected—viz., the means for classifying the removed culinary items may be positioned so as to effect the classification of said items after they have been cleaned (FIG. 1) or it may be positioned to do this before they are cleaned (FIG. 13). In the latter case each type of classified article is kept isolated from the other type(s) during subsequent operations such as washing, rinsing and drying (note FIG. 13).

Reference to FIGS. 2A, 2B, 3A, and 3B also reveals that in the scullery apparatus of this invention the handling of the trays and refuse is preferably effected by apparatus which comprise means for removing refuse from carrying trays; means for washing the carrying trays; means for collecting and comminuting refuse removed from the carrying trays; means for automatically flushing comminuted refuse out of the apparatus; and means for collecting the washed trays. While various methods and apparatus may be used for removing the refuse from the carrying trays such as the tray tipping equipment described in U.S. Pat. Nos. 3,223,097 or 3,486,939, it is preferable to provide means which function by overturning the trays onto conveyor means, particularly conveyor means which have open spaces therein—such as, for example, two or three suitably spaced apart parallel endless belts traveling in the same direction and in the same horizontal plane at the same rate of speed, each being sufficiently narrow in width so that at least a portion of the refuse released from the overturning trays may pass through the open spaced conveyor means and thence to means for collecting the refuse. This feature of open spaced conveyors is illustrated in FIG. 3A. Besides facilitating the refuse collecting operation, such overturning permits the trays to be washed in the overturned position so that food or other debris can more readily be washed or rinsed away from the trays. Also, washing of the trays in the overturned position prevents water from being retained in the trays by the upstanding edges and/or recessed food-receiving areas which are common features of conventional serving or cafeteria-type trays. Furthermore, the washed trays can be easily dried and collected for reuse when carried to the collection station in overturned poisition. It will be noted that the use of open spaced conveyor means not only facilitates refuse collection but makes it possible to spray wash and then dry the trays in overturned position while they are traveling toward the tray collecting station. Note in this connection FIGS. 2A, 2B, 3A and 3B.

Figure 2A:
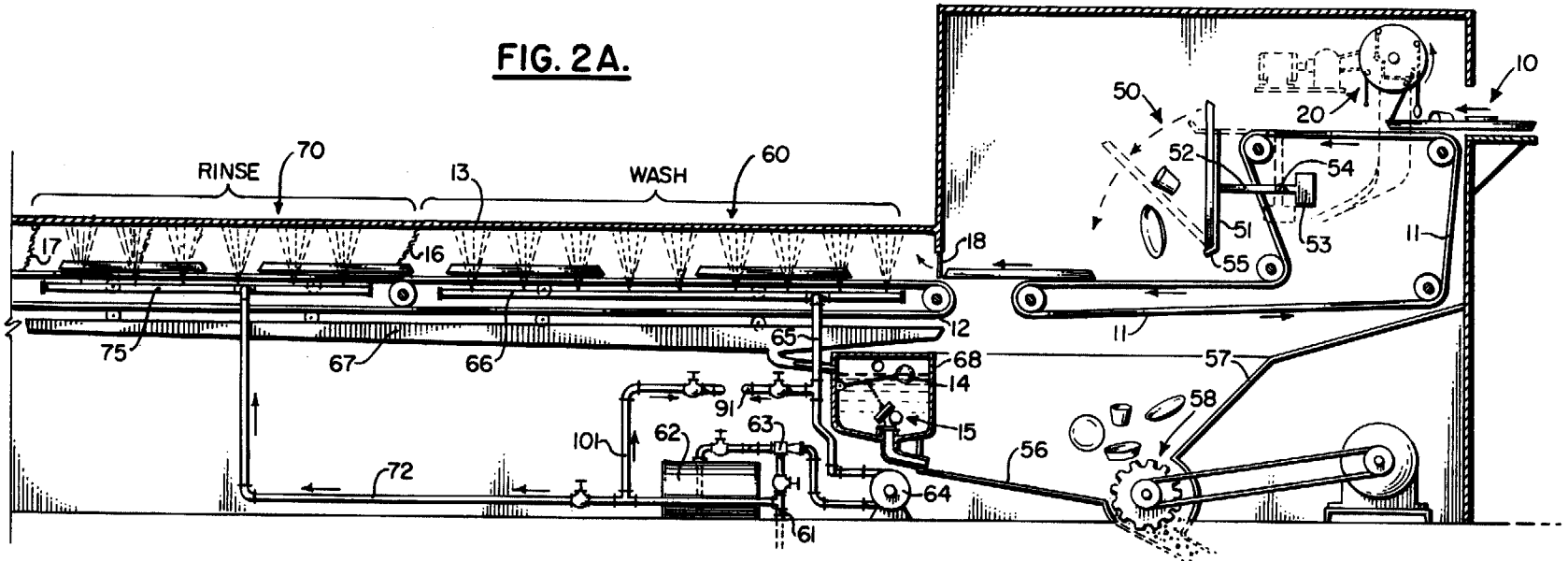
FIGS. 2A and 2B taken together constitute a side elevational view of preferred apparatus for carrying out the operations referred to in FIG. 1.

As FIGS. 2A and 14 indicate, it is particularly advantageous to utilize waste water from at least the tray washing means for flushing the comminuted refuse out of the apparatus. Besides conserving water, this feature takes advantage of the fact that in most tray washing operations it is desirable to employ hot water and effective soaps, detergents or other cleansing agents and such hot solutions help to keep the comminuted solids in suspension as well as cleanse the disposal system. An alternative is to effect the flushing with waste water from the cleansing system for culinary items removed from the trays, and this may be combined with the waste water from the tray washing operation, if desired. Also water used in rinsing the trays or the washed culinary items can be employed in the refuse flushing operation. In all such cases the flushing is done automatically and preferably on a periodic basis so that comminuted refuse is not allowed to excessively accumulate in the apparatus or associated drain pipes.

Turning now more particularly to the embodiments depicted in the Drawings trays carrying, inter alia, magnetically-responsive silverware are introduced into the apparatus through opening 10 where they are received and carried by endless conveyor 11 to silverware retriever 20 where the silverware is magnetically removed and processed as described in more detail hereinafter. Conveyor 11 is driven by any suitable power source (not shown) such as an electric motor or the like and travels in the direction shown in FIG. 2A by the arrows on an appropriate number of suitably placed rolls. In the system depicted, conveyor 11 is composed of several flexible narrow belts which are laterally spaced from each other by a suitable distance so that they can support and carry the trays and yet furnish openings therebetween for platform members 51 of tray inverter 50 as well as openings through which refuse may pass when the trays are overturned by tray inverter 50 as described hereinafter. Alternatively, conveyor 11 may be composed of a web of belting having openings in the web of sufficient size to permit refuse to pass through such openings during the tray overturning operation of inverter 50. Further, it is possible to design the system so that nonperforate belting may be employed—e.g., by using two or more separate serially-arranged conveyors with suitable refuse-receiving gaps therebetween. It will be understood of course that when using alternative arrangements of this type platform members 51 will be positioned further downstream than shown so as to receive the trays as they leave a conveyor belt for overturning. These and other modifications in the apparatus herein described will become readily apparent to those skilled in the art as this description proceeds.

In the form depicted, tray inverter 50 is composed of platform members 51 carried on arms 52, each of which has a counterweight 53 at its other end. Arms 52 are pivotally supported on spindle 54 and the entire unit is balanced such that when a tray encounters lip 55 the arms 52 pivot forwardly (as shown in FIG. 2A) whereby the tray is flipped over onto conveyor 11 so that the tray is in overturned position thereon. Once tray inverter 50 is relieved of the weight of the tray, counterweights 53 cause inverter 50 to return to its normal position with platform members 51 in horizontal tray-receiving position. As noted above and depicted in FIG. 2A, the open spaces in conveyor 11 permit the refuse (disposable dishes, food waste, etc.) to pass through the conveyor and fall into a refuse collection bin defined in part by sloping walls 56, 57. The collected refuse is comminuted by a grinder 58 of any suitable type or design. Means (not shown) may be included in the bin for magnetically capturing any silverware items that may inadvertently pass through retriever 20 so that the times do not reach grinder 58. For example a deflector or baffle may be positioned over the grinder to direct the falling refuse toward wall 56 so that the refuse slides on wall 56 on its way toward grinder 58 whereby suitably positioned magnets (for instance, a magnetic surface in or directly underneath wall 56) can attract and hold any stray silverware item for manual removal from the bin.

If desired, the tray inverter 50 may be equipped with sensing means (not shown) so that when a tray is suitably positioned on platform members 51 for overturning, the power to conveyor 11 is temporarily disconnected or discontinued so that the conveyor 11 is stopped while the tray is being overturned and conveyor 11 does not resume operation until platform members 51 have returned to their normal horizontal tray-receiving position. In addition, the tray inverter 50 may be driven by driving means (not shown) which are actuated by a suitably positioned sensing device when a tray has reached the proper position for overturning. Another variant is to include sensing means (not shown) which cause conveyor 11 to be temporarily slowed down or stopped when each successive tray is within the operating range of silverware retriever 20.

In the embodiment depicted in the Figures the overturned trays are transferred by conveyor 11 to conveyor 12 which carries the overturned trays through washing system 60, rinsing system 70 and drying system 80. From the preceding description it will be appreciated that various different conveyor arrangements are suitable for use not only for conveyor 11 but for conveyor 12 as well. Thus for either or both such conveyors use may be made of systems using parallel V-belts, parallel flexible chains, parallel flat belts, belts of link, and the like. Conveyor 12 is preferably composed of a flexible web made of mesh so that the web furnishes an open-spaced grid or network supporting and carrying the inverted trays, as this facilitates the washing and drying operations. However, any conveyor arrangement affording suitable openings for washings, rinsing, drying and/or drainage purposes, such as parallel narrow belts having suitable openings between them, are also satisfactory. It is not necessary to employ separate conveyors 11 and 12 as these can be connected to form one continuous endless conveying system. However, the use of separate conveyors 11 and 12 as shown is convenient, and it affords the opportunity for independent operation so that either conveyor may be temporarily stopped or slowed down as one or more operations are performed on the trays being carried thereby.

As the trays pass into the washing system 60 they preferably pass under flexible guard 18 which will force off of the overturned trays any disposable culinary items or other refuse that may have landed thereon by virtue of the overturning of a subsequent tray. The refuse dislodged by guard 18 tends to fall between conveyors 11 and 12 and thence to the refuse collection bin defined in part by sloping walls 56, 57 where it is comminuted by grinder 58.

Washing system 60 as shown is composed of inlet pipe 61, tank 62, eductor 63, pump 64, riser 65, spray headers 66, catch basin 67 and flush tank 68. Inlet pipe 61 conveys water, preferably hot water, from a source (not shown) such as a boiler or the like through pump 64 which increases its pressure and delivers it through riser 65 to the spray headers 66. Tank 62 contains a solution of soap, detergent or other suitable cleansing formulation which is metered into the incoming water by means of eductor 63 so that the washing mixture is of the proper strength or concentration. In this way a powerful spray of hot cleansing solution impinges upon the trays as they proceed in overturned position through the washing system. Cleaning solution deflected or falling downwardly from the watertight cabinet wall 13 cleanses the bottom of the trays. Additional downwardly directed sprays (not shown) may be employed for this purpose if desired. Further, the sprays such as the spray headers 66 may be attached to riser 65 by flexible couplings and caused to oscillate if desired. Also rotating brushes or other scrubbing members (not shown) may be included in washing system 60 should these be desired. Waste water containing the cleansing agent and matter washed from the trays falls into catch basin 67 and flows into flush tank 68. When float 14 within flush tank 68 reaches a predetermined level by virtue of the filling of the tank with this hot waste water, valve 15 or other suitable dispensing means is opened (to the position depicted in FIG. 15A) so that a cascade of this waste water runs down wall 56 and flushes comminuted waste through grinder 58 and into the drain or other waste receiving means (not shown). FIG. 15 shows in more detail one typical arrangement for opening valve 15 and keeping it open until flush tank 68 has emptied most of its contents at which point valve 15 closes.

Next the overturned trays on conveyor 12 pass through flexible curtain 16 into rinsing system 70, curtain 16 serving the function of keeping sprayed cleansing solution from entering into the rinsing system. Rinsing system 70 as depicted involves line 72 and spray headers 75, as well as a continuation of catch basin 67. Water from inlet pipe 61 passes via line 72 into headers 75 where it emerges as a spray to rinse the trays passing thereover on conveyor 12. The bottoms of the trays are rinsed by water deflected or dropping from cabinet wall 13 although here again extra sprays (not shown) may be provided for this purpose if desired.

Drying system 80 is the next station through which the overturned trays pass on their journey on conveyor 12. This system, as in the case of the other systems depicted, is susceptible to considerable variation in construction and operation. In the form depicted the trays pass through flexible curtain 17 and under electric heater 82 which effects the drying. Curtain 17 prevents the entry into drying system 80 of spray from rinsing system 70. The dried trays emerge from the drying system through gate 19 which helps to retain the heat within drying system 80. Hot air blowers (not shown) or any other suitable drying system may be utilized.

Figure 2B:
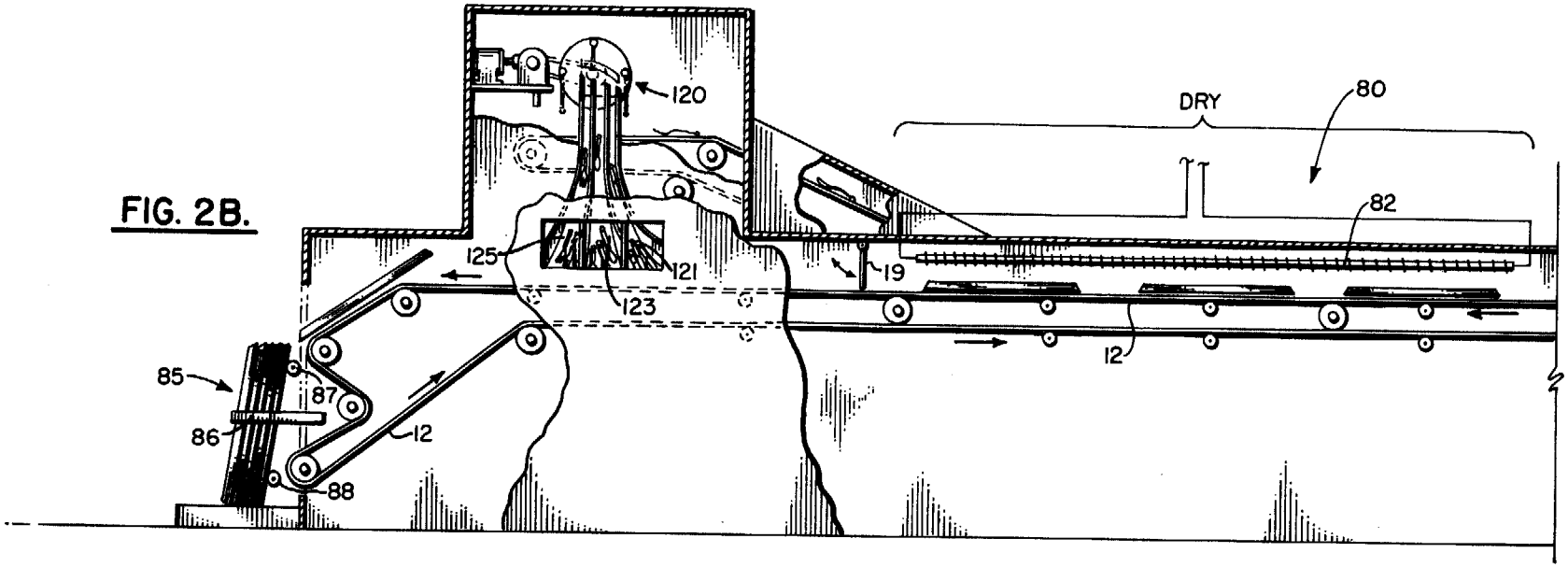

The dried trays are then conveyed to a tray collecting system 85 schematically depicted in FIG. 2B as comprising an expandable/contractable tray retainer 86 and rollers 87, 88. This or any other suitable arrangement receives and stacks the cleaned and dried trays at a convenient location for reuse. The trays may be stacked on edge (as shown) or they may be collected in horizontal position. However, it will be noted that because the trays are in inverted position as they approach collecting system 85, the edges of the trays help guide the trays into the nested position shown in FIG. 2B as each successive tray passes between rollers 87, 88 and the preceding tray held in forwardly sloped, upstanding position by the system. Accordingly, edgewise stacking as depicted is deemed preferable. It will be appreciated that in the system schematically depicted in FIG. 2B retainer 86 expands to accommodate each additional tray as it is received and contracts when one or more trays are removed from the stack.

As pointed out earlier in this detailed description of the apparatus depicted in the Figures, trays subjected to the various operations described above initially carry, inter alia, magnetically responsive silverware which is recovered for reuse. For this purpose it is of decided advantage to utilize silverware having at the end of the handle a generally spherically shaped magnetically responsive end portion, the balance of the article being essentially non-magnetically responsive. FIGS. 4, 4A, 5, 5A, 6 and 6A depict preferred silverware articles of this type wherein the spherical end portions are formed from iron or other suitable magnetic metals or alloys either in integral form (e.g., coated or uncoated solid or hollow spheres) or in finely divided form as a filler in an appropriate plastic matrix. The balance of the article is preferably fabricated from stainless steel or plastic material, although other nonmagnetic metals or alloys are available and suitable for use. An important feature of such articles of silverware is that the magnetically responsive end portions—i.e., the spherical portions of the articles shown in FIGS. 4, 4A, 5, 5A, 6 and 6A—differ in cross-sectional size according to the article, like articles having end portions of like cross-sectional size. For example, the forks will all have spherical cross sections of one given dimension (Dimension A in FIG. 4), the spoons will all have spherical cross sections of another given dimension (Dimension B of FIG. 5), and the knives will all have spherical cross sections of still another dimension (Dimension C of FIG. 6). In these Figures the knives are shown as having spherical end portions of the largest cross-sectional size and the forks are shown as having spherical end portions of the smallest cross-sectional size, the spoons having spherical end portions of intermediate size—i.e., Dimension C is greater than Dimension B and Dimension B is greater than Dimension A. It will of course be readily apparent that any given type of article (knife, fork or spoon) may be assigned any given dimension—the allocation of dimensions to the articles is largely discretionary. The important feature is that whether of largest or smallest or of an intermediate size, all of one given type of article has a given cross-sectional size for its spherically shaped end portions and that particular size differs from the size assigned to another given type of article. It will also be appreciated that there may be as many different cross-sectional sizes employed as there are differing articles of silverware to be retrieved and sorted. For example if the silverware employed only involves forks and spoons, two different cross-sectional dimensions for the respective spherically shaped end portions will suffice. On the other hand six different cross-sectional dimensions would be involved when employing silverware made up of regular forks, salad forks, teaspoons, soup spoons, table spoons and knives.

Referring now to the operations involving the silverware, the system referred to in FIGS. 1, 2A, and 2B, 3A and 3B, and 10A and 10B involves use at the outset of silverware retriever 20, best seen in FIGS. 7 and 8. In essence retriever 20 comprises magnetic means for magnetically engaging the tray-carried silverware articles and removing them from the trays. In the form depicted retriever 20 comprises a rotating assembly made up of wheel 21 supporting at its periphery a plurality of spaced apart horizontal shafts 22, each of which in turn rotatably supports a plurality of fingers 23 depending downwardly therefrom. The retriever as depicted in FIGS. 7 and 8 has four shafts 22 spaced at 90° intervals on wheel 21 and each such shaft carries 10 fingers 23 so that the device illustrated has a total of 40 fingers. There can of course be any suitable number of such shafts and such fingers in the apparatus. The extremity of each finger 23 has a spherical magnet 24 for effecting magnetic engagement with a spherical end portion of an article of silverware carried on a tray. As shown by FIG. 9 the cross-sectional size of the magnets 24 (Dimension D) is preferably smaller than the cross-sectional size of the smallest spherical end portion of the silverware employed (Dimension A of FIG. 4). Wheel 21 is rotatably supported on stationary axle 25 by hub 26 and bearing 27, the fastening being effected by means of threaded stud 28 and nut 29. The opposite end of stud 28 is welded or otherwise firmly attached to base plate 33 which in turn is suitably fastened to an appropriately braced or reinforced support. Washer 30 serves as a bearing surface between nut 29 and the interior of wheel 21. Rotation of wheel 21 is effected by means of belt 31 and pulley 32, the latter being fastened around hub 26 so that the hub and wheel 21 rotate as a unit on bearing 27 and its supporting axle 25 when belt 31 and pulley 32 are driven by a motor or other prime mover (not shown). To further reduce friction, bearing 37 is interposed between plate 33 and the outer end of hub 26. Preferably wheel 21 is rotated so that its lower portion travels toward the direction from which the trays come (note the arrows in FIG. 7). As shown by FIG. 8 silverware retriever 20 is positioned so that shafts 22 extend across conveyor 11. In addition the elevation of the apparatus is arranged such that at the lowermost portion of their travel in their respective circular paths of travel each row of fingers 23 is able to sweep over the surface of a tray positioned on conveyor 11 and thereby enable the spherical magnets 24 to seek out the magnetically responsive spherical end portions of the silverware articles resting on the tray. It will be seen therefore that rotation of wheel 21 causes the fingers to sweep over the trays and as a result magnetic attachments are effected between spherical magnets 24 and the spherical end portions of the silverware such as is depicted in FIGS. 7, 8 and 9. Continued rotation of the wheel results in the magnetically attached silverware being lifted off of the trays and carried upwardly over the conveyor in arcuate paths in vertical planes parallel to the major axis of the conveyor, there being ten such planes for the silverware retriever depicted since ten fingers 23 are shown on each shaft 22.

At a suitable elevation along these arcuate paths of travel there is supported a silverware disengager 34 composed of a plurality of upstanding dividers or walls 35 defining channels through which magnets 24 may pass. Hence for the apparatus depicted there are ten such channels. The walls 35 are sloped toward each other in a vertical direction so that the top of each such channel is wide enough throughout its entire length to permit passage of finger 23 and the bottom of each such channel is wider than the larger or largest cross-sectional size (diameter) of the spherical end portions of the silverware employed in the operation. In addition the walls 35 converge toward each other either continuously or in incremental stages along the path of travel whereby the width of the channels progressively narrows continuously or in incremental steps or stages so that although magnet 24 can pass along an arcuate path throughout the entire channel, the spherical end portions of the magnetically engaged silverware articles cannot pass through the full length of the channels. Thus at the entrance to the channel the walls are sufficiently far apart so that irrespective of size any spherical end portion of a silverware article suspended as in FIG. 9 can enter into the channel belonging to the particular finger and magnet by which the article is carried. However at a suitable location along the path of travel the walls 35 close toward each other above and at the sides of the arcuate path through which magnets 24 pass so that the channel is constricted and tapered to a sufficient extent that no spherical end portion of any magnetically-carried article of silverware may pass and further, either forwardly or upwardly. Since the magnets 24 are being pulled through their respective channels by fingers 23, shafts 22 and wheel 21 rotating as a unit, the magnets are pulled away from the silverware articles which are then free to drop into chute 36. In short, walls 35 converge along the predetermined path of travel of the spherically-shaped end portions of the silverware until a location is reached at which the end portion can proceed no further (except downwardly). At this location the magnet 24 and the silverware articles are disengaged and the article drops to the chute 36.

It will be noted that since the cross-sectional sizes of the different articles of silverware differ from type to type there are a plurality of locations along the arcuate path of travel through the channels at which disengagement occurs. In other words, the articles with the larger or largest spherically shaped end portions are disengaged at a location closer to the entrance than the location at which the articles with the smaller or next smaller spherically shaped end portions are disengaged, and so on.

A variation in the design of disengager 34 involves shaping and positioning walls 35 so that magnets 24 actually emerge from the top of their respective channels at an appropriate location along their respective paths of travel. The channels are progressively narrowed by the opposed walls 35 as the location of magnet emergence is approached so that no spherical end portion of the silverware can reach the location of magnet emergence. As before, the result is that each item of silverware is "pinched off" by the walls and falls to chute 36.

The articles of silverware slide down chute 36 and drop onto conveyor 40 fabricated from a flexible web of mesh having a small enough network to retain the silverware articles yet large enough to permit the passage of sprays therethrough. Conveyor 40 carries the silverware through washing system 90, rinsing system 100, drying system 110 and thence to silverware classifier 120. On passing into washing system 90 the silverware articles pass under flexible curtain 41 which helps keep the sprays confined to the desired area. Washing system 90 is composed of line 91, spray headers 92, catch basin 93 and return line 94. Line 91 receives washing solution from pump 64 and feeds it into spray headers 92 which cleanse the silverware by means of high pressure spraying. The spray headers may of course spray downwardly on the silverware should this be desired. Scrubbing means or soaking stations (not shown) can also be employed, if desired. Catch basin 93 captures the waste water from the spraying operation and transfers it to return line 94 which empties into flush tank 68.

On leaving the washing system, the silverware passes under flexible curtain 42, which serves the same type of function as curtain 41, and enters rinsing system 100 composed of line 101, spray headers 103 and an extension of catch basin 93. In this system the silverware is rinsed free of residual cleaning solution. Next the silverware is carried by conveyor 40 under flexible curtain 43 into drying system 110 wherein drying is effected by means of electric heaters 115 or other suitable drying equipment. Thereupon the dried silverware is carried up an incline to the silverware classifier 120, best seen in FIGS. 11 and 12.

Classifier 120 is constructed and operates in essentially the same fashion as silverware retriever 20 described above. The principal differences between the two are that in classifier 120 the silverware is magnetically retrieved directly from conveyor 40 rather than from trays; three chutes, 121, 123 and 125 are employed instead of one; and the device is utilized not only for retrieving the silverware but for sorting it automatically according to type. Thus for a detailed description of silverware classifier 120 reference should be had to the detailed description of silverware retriever 20. The feature to be noted at this juncture is that because of the progressive convergence of walls 35 along the arcuate paths of travel through the channels combined with the vertical inward taper of the channels the classifier is capable of disengaging the magnetically-carried silverware at various locations along the path, the location of the disengagement being governed by the cross-sectional size (diameter) of the end portion of the silverware article being carried. Since, in the system depicted, three types of silverware articles are employed (each type having spherically shaped end portions differing in cross section or diameter from the other two types) there are three different locations along the path of travel through the channels defined by walls 35 where disengagement occurs. The silverware articles with the largest spherical end portions (in this case, the knives) are disengaged at a location nearest to the entrance to the channels above chute 121 and thus drop into chute 121. The articles with the next smaller spherical end portions (here, the spoons) are disengaged further along the path of travel in the channels, namely, above chute 123 into which they drop. The articles having the smallest spherical end portions (in this instance, the forks) are disengaged near the end of the path of travel in the channels above chute 125 and fall therein. Thus the apparatus automatically and continuously retrieves, classifies and separates the silverware.

In the system depicted the cleaned and dried silverware articles, after sorting by type, slide in their respective chutes 121, 123, 125 into collection bins where they are available for reuse. Note FIGS. 2B and 3B.

It will of course be appreciated that the respective washing and rinsing systems are housed in appropriate watertight compartments. Also sensing means and automated valves may be incorporated in the apparatus to shut off the sprays in the washing and rinsing systems when their use is not required. The source of heat in the drying systems may be similarly automated.

The preferred scullery system of FIG. 13 may be arranged and constructed in very much the same fashion as the system described in detail hereinabove by substituting for silverware retriever 20, a silverware classifier 120 with an appropriate number of chutes leading to a corresponding number of parallel conveyors with dividers between them so that the isolated classified articles are passed through a washing system such as system 90, a rinsing system such as system 100 and a drying system such as system 110. Thereupon the dried articles can be conveyed directly to separate chutes leading to separate collections bins.

For simplicity FIG. 13 refers to classifying and isolating two types of culinary items (Type A and Type B which may be plates and spoons, knives and forks, etc.) and FIG. 1 refers to three classified and isolated types (Types A, B and C). Any reasonable number of different types can be sorted by properly designed systems of this invention, however. For further details on retrieving and sorting apparatus one may refer to my application Ser. No. Case 410,481, filed Oct. 29, 1973, now U.S. Pat. No. 3,877,577.

FIG. 14 describes still another systems of this invention, one important aspect of which is the automatic, periodic flushing of the comminuted refuse out of the apparatus. FIGS. 15 and 15A illustrate an arrangement for effecting periodic flushing of this type. In this apparatus waste water from catch basin 67 returns to flush tank 68 via line 45 and waste water from catch basin 93 returns thereto via return line 94. Float 41 is fastened to an inside wall of tank 68 by arm 46 and pivot 47 so that the float rises and falls with the level of water within the tank. The valve 15 shown closed in FIG. 15 and open in FIG. 15A is composed of pipe 48, hinged cap 39 which fits over the mouth of pipe 48, weight 44 toward the front end of hinged cap 39, and bottom-apertured cup 49 toward the back end of hinged cap 39. Cup 49 and arm 46 are connected by chain 38. When tank 68 has filled sufficiently the upward pull on arm 46 and chain 38 due to the rising of float 14 causes cap 39 to open so that it reaches the position shown in FIG. 15A, this movement being assisted by the rush of water into pipe 48 as cap 39 is opened. Also valve 15 is shaped and hinged so that it is near the point of balance when closed, and this further assists the movement from the closed position of FIG. 15 to the open position of FIG. 15A. When the level of the water falls below cup 49 the water therein passes through the aperture in the bottom thereof so that the downward moment of weight 44 tending to close the valve exceeds the downward moment of cup 49 tending to keep the valve open. Consequently, hinged cap 39 swings to a closed position and seals off the mouth of pipe 48 so that flush tank 68 is again refilled and the cycle repeated.

It will be understood that cetain features and subcombinations are of utility and may be employed without reference to other features and subcombinations. This is contemplated by and is within the scope of the claims. By way of example, this invention can be applied to the classification and collection of culinary items and collection of carrying trays without necessarily subjecting any such articles to a cleaning operation by the apparatus. Such an apparatus comprises, for example, conveyor means for conveying carrying trays having thereon magnetically responsive culinary items; means for magnetically removing magnetically resonsive culinary items from trays on said conveyor means; means for classifying said removed items according to like articles and isolating said classified articles each from the other; means for overturning the carrying trays so that refuse may be released therefrom; means for collecting and comminuting refuse released from the overturned trays; and means for collecting the trays after they have been overturned. These and other variants will now be readily apparent to those skilled in the art on the basis of the foregoing description.

As many possible embodiments may be made of the invention without departing from the scope thereof, it is to be understood that all matter herein set forth or shown in the accompanying drawings is to be interpreted as illustrative and not in a limiting sense.

I claim:

1. Automatic scullery apparatus which comprises:
conveyor means for conveying carrying trays having thereon, inter alia, magnetically responsive culinary items;
means for selectively magnetically removing magnetically responsive culinary items from trays on said conveyor means while leaving nonmagnetically responsive residual contents on said trays; and
means for collecting and cleansing the removed culinary items.

2. Apparatus according to claim 1 further including means for classifying the removed culinary items according to like articles and isolating the classified articles each from the other.

3. Apparatus according to claim 2 wherein said means for classifying the removed culinary items effects the classification of said items after they have been cleansed.

4. Apparatus according to claim 2 wherein said means for classifying the removed culinary items effects the classification of said items before they are cleansed.

5. Automatic scullery apparatus which comprises:
means for conveying carrying trays having culinary items and refuse thereon;
means for magnetically engaging tray-carried magnetically responsive culinary items and removing said items from the conveyed carrying trays so that said items are selectively removed from the conveyed carrying trays and the refuse remaining thereon;
means for disengaging the magnetically engaged culinary items;
means for collecting and washing the disengaged culinary items;
means for removing from the carrying trays the refuse remaining thereon; and
means for cleaning the carrying trays.

6. Apparatus according to claim 5 wherein the means for removing refuse from the carrying trays includes means for overturning the trays.

7. Apparatus according to claim 5 including (a) means for collecting refuse removed from the carrying trays and (b) open spaced conveyor means for conveying the trays toward the means for cleaning the trays, the means for removing refuse from the trays including means for overturning the trays onto said open spaced conveyor means so that at least a portion of the refuse released from the overturning trays may pass through the open spaced conveyor means and thence to the means for collecting refuse.

8. Apparatus according to claim 7 further including means for comminuting and flushing the refuse.

9. Apparatus according to claim 5 including (a) means for collecting refuse removed from the carrying trays, (b) open spaced conveyor means for conveying the trays toward the means for cleaning the trays, and (c) open spaced conveyor means for conveying the trays through the means for cleaning the trays, the means for removing refuse from the trays including means for overturning the trays onto the open spaced conveyor means of (b) so that at least a portion of the refuse released from the overturning trays may pass through the open spaced conveyor means of (b) and thence to the means for collecting refuse, the means for cleaning the carrying trays including means for spray washing the trays in overturned position on the open spaced conveyor means of (c).

10. Apparatus according to claim 9 further including means for comminuting and flushing the refuse.

11. Apparatus according to claim 5 including means for classifying the culinary items according to like articles and isolating the classified articles each from the other.

12. Automatic scullery apparatus which comprises:
conveyor means for conveying carrying trays having thereon, inter alia, table silverware having magnetically responsive end portions;
means for magnetically engaging said magnetically responsive end portions and removing said silverware from trays on said conveyor means;
means for collecting, washing and drying said removed silverware;
means for classifying said washed and dried silverware according to like articles and isolating said classified articles each from the other;
means for collecting and dispensing said isolated articles;
means for removing refuse remaining on the carrying trays after the removal of said table silverware therefrom;
means for collecting, comminuting and flushing refuse removed from the trays;
means for washing and drying the trays; and
means for collecting and dispensing the washed and dried trays.

13. Apparatus according to claim 12 wherein the magnetically responsive end portions of said table silverware differ in cross-sectional size, like articles having end portions of like cross-sectional size; and wherein said means for classifying said washed and dried silverware comprises:
magnetic means for magnetically engaging said washed and dried silverware by means of said end portions;

means for moving said magnetic means and engaged silverware along a predetermined path of travel;

means along said predetermined path of travel for disengaging said magnetic means and engaged silverware articles at one of a plurality of different locations, the location at which disengagement occurs being dependent upon the cross-sectional size of the end portion of the silverware article being disengaged; and means associated with each location for collecting the articles disengaged at said location.

14. Automatic scullery apparatus which comprises:

conveyor means for conveying carrying trays having thereon, inter alia, table silverware having magnetically responsive end portions;

means for magnetically engaging said magnetically responsive end portions and removing said silverware from trays on said conveyor means;

means for classifying said removed silverware according to like articles and isolating said classified articles each from the other;

means for collecting, washing and drying said isolated articles;

means for collecting and dispensing said dried isolated articles;

means for removing refuse remaining on the carrying trays after the removal of said table silverware therefrom;

means for collecting, comminuting and flushing refuse removed from the trays;

means for washing and drying the trays; and means for collecting and dispensing the washed and dried trays.

15. Apparatus according to claim 14 wherein the magnetically responsive end portions of said table silverware differ in cross-sectional size, like articles having end portions of like cross-sectional size; wherein said means for magnetically engaging said end portions and removing said silverware from the trays is magnetic means which moves the magnetically engaged silverware along a predetermined path of travel to said means for classifying said removed silverware; and wherein said means for classifying said removed silverware comprises:

means along said predetermined path of travel for disengaging said magnetic means and engaged silverware articles at one of a plurality of different locations, the location at which disengagement occurs being dependent upon the cross-sectional size of the end portion of the silverware article being disengaged; and means associated with each location for collecting the articles disengaged at said location.

* * * * *